United States Patent [19]

Bartell et al.

[11] Patent Number: 4,905,866

[45] Date of Patent: Mar. 6, 1990

[54] PILL DISPENSER WITH INCREMENTALLY MOVABLE PILL EJECTOR

[75] Inventors: Ralph Bartell, Lincoln Park; Frank Neggers, Lake Hopapcong, both of N.J.

[73] Assignee: Warner-Lambert Company, Morris Plains, N.J.

[21] Appl. No.: 118,509

[22] Filed: Nov. 9, 1987

[51] Int. Cl.[4] ..... B65D 83/04; B65D 85/56

[52] U.S. Cl. ..... 221/5; 221/88; 206/531; 206/534; 206/539

[58] Field of Search ..... 221/2, 4–5, 221/25, 69, 87–89; 206/531–534, 538–539; 116/308

[56] References Cited

U.S. PATENT DOCUMENTS

| | | | |
|---|---|---|---|
| 2,431,490 | 11/1947 | Lauer | 206/539 |
| 3,279,651 | 10/1966 | Thompson | 206/531 X |
| 3,494,322 | 2/1970 | Dubbels | 206/534 |
| 3,651,927 | 3/1972 | Richardson et al. | 221/5 |
| 3,904,075 | 9/1975 | Richardson et al. | 221/5 |
| 4,074,806 | 2/1978 | Ardito | 221/87 X |
| 4,473,156 | 9/1984 | Martin | 206/534 |

FOREIGN PATENT DOCUMENTS

| | | | |
|---|---|---|---|
| 2919713 | 11/1980 | Fed. Rep. of Germany | 206/531 |

*Primary Examiner*—Joseph J. Rolla
*Assistant Examiner*—Edward S. Ammeen
*Attorney, Agent, or Firm*—Francis J. Tinney

[57] ABSTRACT

A device for holding and dispensing pills which enables the dispensing of pills in successive order. Pills are mounted in a compact in a single row in the desired successive order and a pill ejector is arranged for incremental movement in one direction along the compact. When the pill ejector is adjacent to a pill, a bendable member is displaced to push the pill out of a blister type package and through an opening in the rear of the compact.

5 Claims, 2 Drawing Sheets

FIG. 1
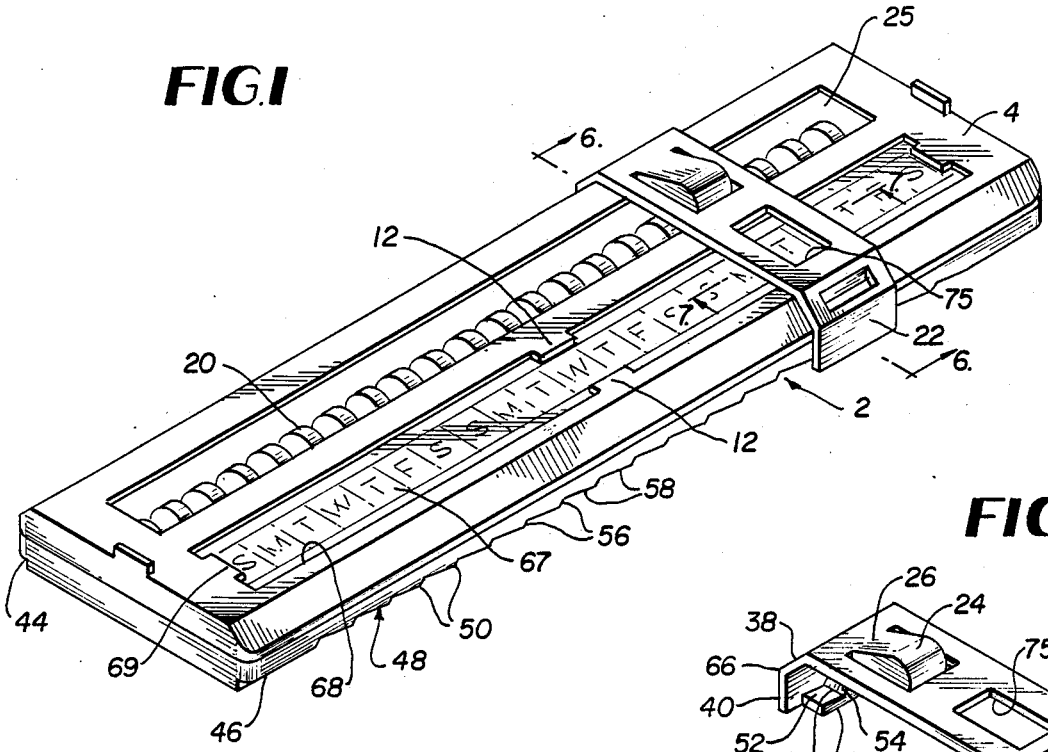
FIG. 5
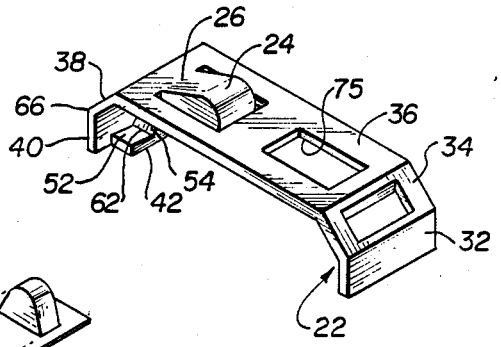
FIG. 3
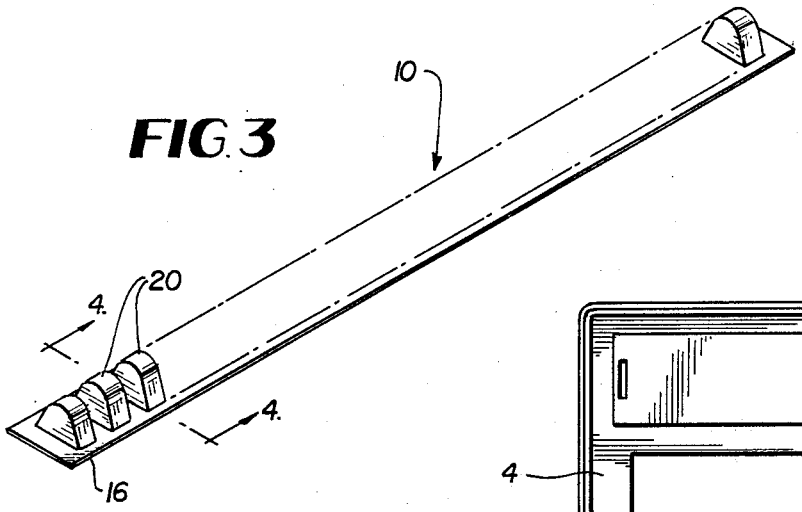
FIG. 2
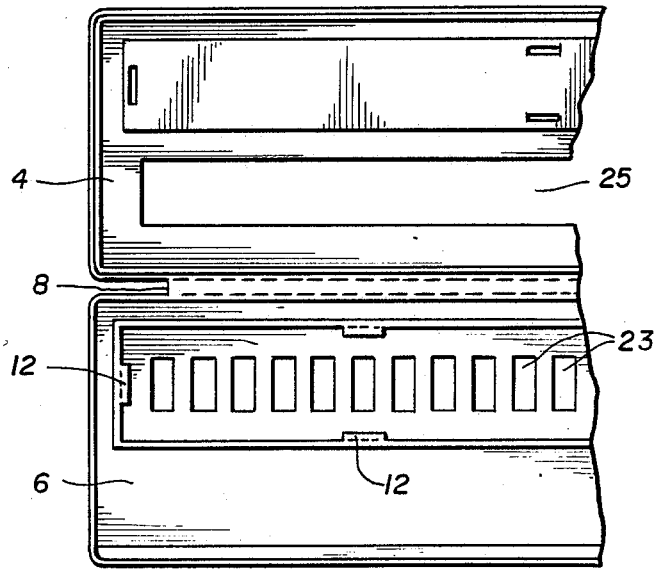
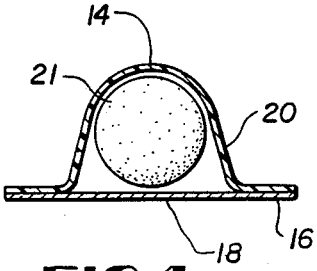
FIG. 4

PILL DISPENSER WITH INCREMENTALLY MOVABLE PILL EJECTOR

The present invention is directed to a device for holding and dispensing pills, and particularly to a device which enables the dispensing of pills in successive order.

In the self-administration of pills, it is frequently necessary that a number of non-identical pills be taken in a predetermined order. The notable example of this is birth control pills, such as the system wherein pills in three different groups are taken over a twenty-one day cycle, the first group of seven pills being taken once a day for the first seven days of the cycle, the second group of seven pills being taken once a day for the second seven days of the cycle, and the third group being taken once a day for the last seven days of the cycle.

It is important in such a regimen that the correct pill be taken each day, and in order to enable compliance, manufacturers have color coded the different pill groups and have arranged packaging for the pills so that a calendar strip is provided wherein days of the week are denoted adjacent respective pills. Additionally, such pills may be sold in a "blister type" package wherein the pills are arranged in a number of rows or in a circle. However, notwithstanding the foregoing cautinary steps which have heretofore been taken, it is possible for the user on occasion to eject and take the wrong pill. For example, a person who is distracted or who has poor vision may inadvertently eject a pill in the wrong row or one which is out of order on the circle.

It is therefore the purpose of the present invention to provide a device which will to a greater degree prevent the dispensing of an incorrect pill.

It is thus an object of the invention to provide an improved device for holding and dispensing pills which need to be taken in successive order.

It is a further object of the invention to provide a dispensing device having a pill ejector means for enabling ejection of pills.

It is still a further object of the invention to provide a dispensing device having a pill ejector means which can be conveniently moved in only a single direction.

It is still a further object of the invention to provide a dispensing device wherein the pills are arranged in a single row.

It is still a further object of the invention to provide an improved holding and dispensing device for birth control pills.

The above objects are accomplished by providing a device wherein pills are ejectably mounted in a predetermined order and wherein a mechanical pill ejector means is provided for enabling ejection of individual pills. The pill ejector means is arranged to be incrementally movable from one pill to the next, and may be easily moved in only one direction. Additionally, the pills are arranged in a single row, so that to take the correct pill, the user need only move the pill ejector means by a single increment along the row each day. Additionally, a calendar strip adjacent the pills is arranged to denote successive days of the week.

In the preferred embodiment, the device is a thin compact which holds a blister type package of pills in a single row. The pill ejector means comprises a slider which is incrementally movable on the compact, and which has a bendable member which is pushed by the user when overlying a pill, so as to contact the pill and force it through the blister type package and out of the compact.

The invention will be better understood by referring to the accompanying drawings in which:

FIG. 1 is a pictorial representation of an embodiment of a pill dispensing device in accordance with the invention.

FIG. 2 is a plan view of the interior of the device when open.

FIG. 3 is a pictorial representation of a blister type pill package.

FIG. 4 is a cross-sectional view of a single pill disposed in the blister type package shown FIG. 3.

FIG. 5 is a perspective view of an embodiment of the pill ejector means of the invention.

Figure 6:
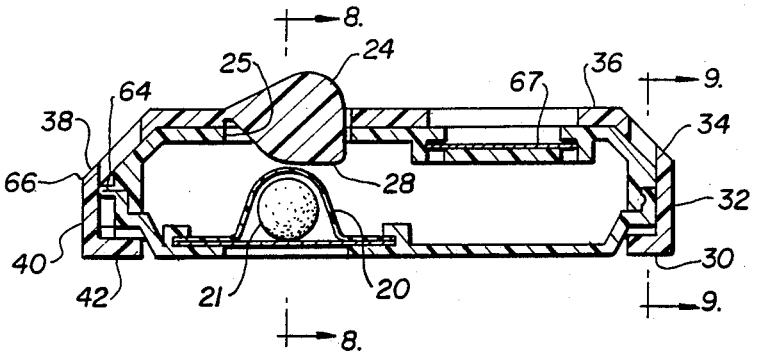
FIG. 6 is a cross-sectional view of the device taken through the pill ejector means, showing such means poised over a pill.
Figure 7:
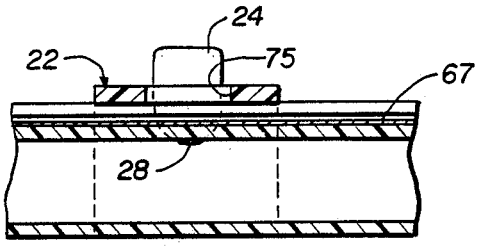
FIG. 7 is a cross-sectional view of a portion of the device taken at lines 7-7 of FIG. 1.

Referring to FIG. 1, pill holding and dispensing device 2 is shown. The device is in the form of a compact, which may conveniently be made of hard plastic.

Referring to FIG. 2, it is seen that the front 4 and rear 6 of the compact are openable and closeable with respect to each other, and are moved around hinge 8.

A strip of pills 10 is disposed in the interior of the compact, as by being slipped under projections 12, which maintain the strip in place. After the pills are all used, the strip 10 is replaced with a new pill package.

The strip of pills 10 is seen in detail in FIGS. 3 and 4, and is a blister type package wherein respective pills may be ejected by pushing the package down on the top of a pill, for example at area 14 in FIG. 4. The base 16 of the package is typically of a foil material, which has weakened portions 18 directly beneath individual pills. Each of the pills is individually enclosed in a transparent plastic package 20, and when a force is exerted on the top of such package, the pill is ejected from the weakened foil portion 18.

It is noted that the rear of the compact has a series of openings 23, and when the pill package is inserted, a pill overlies each opening. Additionally, the front of the compact has a single, elongated opening 25, through which the pills may be observed.

Referring to FIG. 5, a pill ejector means 22 is shown. This is a molded plastic piece which comprises a slider which is mounted on the compact 2 so as to be incrementally movable from pill to pill. The pill ejector means has a bendable member 24 which is secured to the remainder of the element only at area 26, so that this area is effectively a hinge around which the member 24 may be moved.

Figure 8:
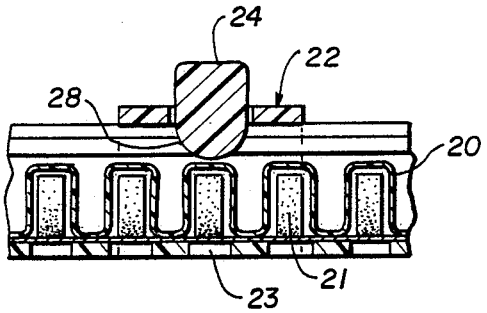
FIG. 8 is a cross-sectional view of a part of the device showing the shape of the pill ejector means across its width.

FIG. 8 shows the shape of the bottom part 28 of the bendable member 24 across its width. In order to eject a pill, the pill ejector means 22 is moved to a pill ejection position overlying a pill, as shown in FIG. 6, whereupon the user depresses bendable member 24 down towards a pill. The bottom part 28 is forced against the pill and forces it out of the blister type package and through an opening 23 in the rear of the compact, as shown in FIG. 10.

Figure 10:
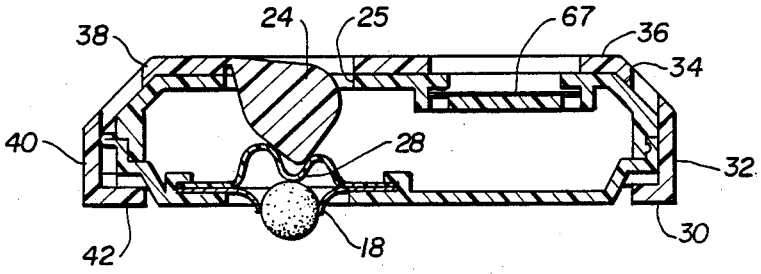
FIG. 10 is a cross-sectional view which shows the pill ejector means in the process of ejecting a pill.

As can be seen by referring to FIGS. 5, 6, and 10, pill ejector means 22 includes portions 30, 32, 34, 36, 38, 40, and 42 which are shaped so as to embrace the compact when ejector means 22 is slipped thereover.

Referring to FIG. 1, the rear surface of the compact has a ledge 44 indented therefrom at the top, and an identical ledge 46 at the bottom. Each of these ledges has a sawtooth surface 48 running therealong, wherein the high areas 50 thereof form a series of abutments. Ledge 46 is shown in detail in FIG. 6.

Figure 9:
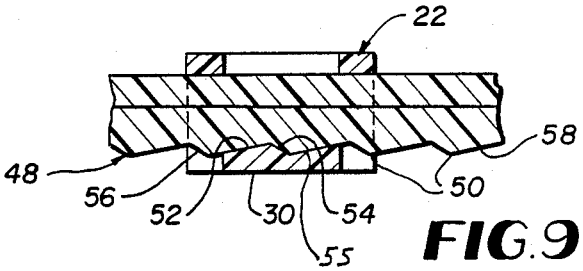
FIG. 9 is an illustration showing the series of abutments which allows incremental movement of the pill ejector means in one direction.

Referring to FIGS. 5, 6, and 9, interior parts 42 and 30 of pill ejector means 22 are divided into surfaces 52 and 55 which are connected by a sloping shoulder 54. As pill ejector means 22 is slid on the compact by the user from left to right in FIG. 1, it will "click" into place and come to rest when sloping shoulder 54 engages smaller sawtooth inclined portion 56 shown in FIG. 1.

Thus, pill ejector means 22 can be moved incrementally in FIG. 1 from left to right. It is noted that raised rail 64, shown in FIG. 6 runs along the length of the compact, and is engaged by corner 66 of the ejector means to facilitate sliding movement. At each incremental resting location, the ejector means is in a pill ejection position overlying an individual pill. However, due to the relative angular disposition of sawtooth edges 44 and 48 and parts 42 and 30 of pill ejector means 22, it is not possible to easily or smoothly move the pill ejector means in the reverse direction, that is from right to left in FIG. 1.

As mentioned above, the invention may be particularly useful in the dispensing of non-identical pills which are to be taken in successive order, such as on consecutive days.

In this regard, referring to FIG. 1, it is noted that a calendar strip 67 may be inserted in recess 68 in the front of compact 1. This strip has the days of the week printed thereon in successive positions, and is preferably detached from a perforated roll, so that the day on which administration of pills is begun appears adjacent the first pill.

In order to take the correct pill, the user need only move pill ejector means 22 by an incremental position each day or each time a pill is required according to a prescribed regimen. The day of the week or other calendar information is framed in window 75 of the ejector means, and when at an incremental position, all the user need do is to depress bendable member 24, whereupon a pill is ejected from the rear of the compact.

In addition to the foregoing, the pills may be color coded to aid in correct administration. For example, as mentioned above, the invention finds particular use as a dispensing device for birth control pills, which may consist of three groups of seven pills administered over a twenty-one day period, each group containing pills of a different strength, with the colors of the pills of the respective three groups being different. In such a case, it may be desirable to make bendable member 24 transparent, so that the pill is visible therethrough to reinforce that the correct pill is being ejected.

There thus has been described a device for holding and dispensing pills in a predetermined order and for aiding in enforcing compliance with a desired regimen.

While the invention has been illustrated in connection with a preferred embodiment, variations will occur to those skilled in the art, and the invention is to be limited only by the following claims and equivalents.

I claim:

1. A pill holding and dispensing device which facilitates the dispensing of birth control pills in successive order, comprising, mounting means for ejectably mounting said pills in discrete spatial locations which are in a straight line in a predetermined and successive order wherein said line of pills includes pills which are not identical to each other wherein part of said mounting means comprises a blister type package in which said pills are disposed wherein on the exterior of said mounting means printed matter is disposed which denotes days of the week, each day appearing in correspondence with a said discrete spatial mounting location for a pill and wherein part of said mounting means comprises a compact which has a rigid rear surface having a series of discrete cut-outs which lie behind respective pills which may be ejected therethrough and wherein said compact further has a series of abutments which correspond in position to said cut-outs and wherein said compact comprises an elongated container having said series of cut-outs in a linear row along the long dimension of the compact, pill ejector means for enabling ejection of individual pills from said mounting means when at ejection positions which are in proximity to the discrete spatial locations of said individual pills in said mounting means, said ejection positions overlie individual pills, and wherein said pill ejection means includes a movable member which may be moved towards said pills when said member is at an ejection position, so as to exert a force on a pill so as to eject it from said blister type package, said pill ejector means has shoulder means for cooperating with said abutments for allowing easy incremental movement of said pill ejector means in one direction only from abutment to abutment, thereby defining said respective ejection positions wherein said abutments comprise portions of a saw-tooth surface, and wherein said movable member of said pill ejector means comprises a bendable member disposed at the front of the compact bendable towards the rear, and wherein the pill ejector means is arranged for sliding movement along the length of the compact, said series of abutments being disposed on the rear of the compact and said pill ejector means being shaped to wrap around the front, top, and bottom, and part of the rear of the compact, said shoulder being disposed on a part of the pill ejector means which wraps around the rear of the compact for engagement with abutments on the rear of the compact so as to facilitate ejection of said pills in said predetermined order.

2. The device of claim 1 wherein there is a rail on the top surface of the compact which is engaged by a corner of the shaped ejector means for sliding movement thereon, and wherein there is an elongated opening in the front surface of the compact extending along the length thereof which overlies the cut-outs in the rear surface, and which through the bendable member of said pill ejector means is displaced.

3. A device for holding and dispensing pills which are enclosed in a blister type package, comprising, means for stationarily mounting a blister type package of pills wherein said means for mounting said blister type package comprises part of a compact in which said package is disposed, the rear of said compact comprising a rigid surface having a series of discrete cut-outs, and said blister type package being mounted so that respective pills overlie said discrete cut-outs for being ejected through said cut-outs, wherein the exterior of said compact has a series of abutments which correspond in position to said series of cut-outs and wherein said compact comprises an elongated container having said series of cut-outs in a linear row along the long dimension of the compact, and wherein said compact is between front and rear surfaces thereof relatively flat mechanical pill ejector means movably mounted in relation to said means for mounting said package of pills for movement to mechanically defined discrete positions overlying said pills, in said blister type package and wherein said pill ejector means has a shoulder which cooperates with said abutments to mechanically define said discrete positions overlying said pills and said mechanical pill ejector means comprising a movable member wherein said movable member of said pill ejector means comprises a bendable member which is movable out of contact with the pill package but which is displaceable towards said package so as to contact the package to exert a force against said pills to eject them from the package through said cut-outs, said movable member of said pill ejector means being at the front surface of the compact while said abutments are located on the rear surface thereof and said pill ejector means further comprises a slidable member which is shaped so as to wrap around the front, top and bottom, and a part of the rear of said compact, said shoulder being disposed at the end of said slidable member for engagement with said abutments on the rear of said compact.

4. The device of claim 3 wherein there is a rail on the top surface of the compact which is engaged by a corner of the shaped slideable member for sliding movement thereon, and there is an elongated opening in the front surface of the compact extending along the length thereof which overlies the cut-outs in the rear surface, and which through said bendable member of said pill ejector means is displaced.

5. The device of claim 4 wherein said compact is hinged for opening and closing by means permitting said front and rear surfaces to move away from and towards each other and wherein the front of said compact includes means for mounting printed material at a mounting position beneath said pills.

* * * * *